US009507305B2

(12) United States Patent
Fukunaga

(10) Patent No.: US 9,507,305 B2
(45) Date of Patent: Nov. 29, 2016

(54) FIXING DEVICE HAVING NIP PRESSURE ADJUSTMENT AND IMAGE FORMING APPARATUS

(71) Applicant: KYOCERA Document Solutions Inc., Osaka (JP)

(72) Inventor: Yasuyuki Fukunaga, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/079,680

(22) Filed: Mar. 24, 2016

(65) Prior Publication Data

US 2016/0291514 A1 Oct. 6, 2016

(30) Foreign Application Priority Data

Apr. 6, 2015 (JP) ..... 2015-077519

(51) Int. Cl.
*G03G 15/20* (2006.01)

(52) U.S. Cl.
CPC ..... *G03G 15/2067* (2013.01); *G03G 15/2032* (2013.01)

(58) Field of Classification Search
CPC ..... G03G 15/2032; G03G 15/2035; G03G 15/2067; G03G 15/2071; G03G 21/1685; G03G 2221/1639
USPC ..... 399/122, 328; 219/216
See application file for complete search history.

(56) References Cited

U.S. PATENT DOCUMENTS 5,926,680 A * 7/1999 Yamamoto ..... G03G 15/2053 399/328
7,620,356 B2 * 11/2009 Moteki ..... G03G 15/2028 399/122
7,664,415 B2 * 2/2010 Mikutsu ..... G03G 15/206 399/328
2002/0031361 A1 * 3/2002 Shiiya ..... G03G 15/2032 399/68
2011/0222881 A1 * 9/2011 Yamada ..... G03G 15/2032 399/45
2014/0270875 A1 * 9/2014 Mimbu ..... B66F 19/00 399/329
2016/0116874 A1 * 4/2016 Tanaka ..... G03G 15/2053 399/328

FOREIGN PATENT DOCUMENTS

JP 08123247 A * 5/1996
JP 2001-201976 7/2001
JP 2008151965 A * 7/2008

* cited by examiner

*Primary Examiner* — Robert Beatty
(74) *Attorney, Agent, or Firm* — Wenderoth, Lind & Ponack, L.L.P.

(57) ABSTRACT

When a roller faces a concave portion of an eccentric cam, a pressure roller is brought into press contact with a fixing roller at the spring pressure of a lower compression spring via a lever and an arm member. When the roller faces a maximum radius part, the pressure roller moves in a direction separating from the fixing roller via the lever and the arm member against the spring pressure of the lower compression spring.

4 Claims, 9 Drawing Sheets

FIXING DEVICE HAVING NIP PRESSURE ADJUSTMENT AND IMAGE FORMING APPARATUS

CROSS-REFERENCE TO RELATED APPLICATION

This application is based upon and claims the benefit of priority from Japanese Patent Application No. 2015-077519 filed on Jun. 6, 2015, the entire contents of which are incorporated herein by reference.

BACKGROUND

The technology of the present disclosure relates to a fixing device having a nip pressure adjustment mechanism for adjusting the nip pressure of a nip portion formed by press-contact between a fixing member such as a fixing roller and a fixing belt and a pressure member such as a pressure roller, and an image forming apparatus including the same.

There is a case in which a fixing device includes a nip pressure adjustment mechanism. The nip pressure adjustment mechanism, for example, adjusts the nip pressure of a nip portion in order to prevent wrinkles at the time of paper passing of an envelope and the like or to prevent concaved permanent strain (a so-called C set phenomenon) occurring when a fixing roller has been left in a press-contact state for a long time.

The nip pressure adjustment mechanism inverts an eccentric cam by 180° by a motor via a driving gear train, thereby switching the position of a minimum radius part and the position of a maximum radius part. In this way, the nip pressure adjustment mechanism increases and decreases spring pressure of a compression spring that presses a pressure roller to the fixing roller, thereby adjusting the pressure of a nip portion.

SUMMARY

A fixing device according to one aspect of the present disclosure includes a fixing member, a pressure member, and a nip pressure adjustment mechanism. The pressure member is brought into press contact with the fixing member. The pressure member interposes a paper carrying an unfixed toner image between the fixing member and the pressure member. Accordingly, the pressure member forms a nip portion between the fixing member and the pressure member. At the nip portion, the unfixed toner image on the paper is melt and is fixed to the paper. The nip pressure adjustment mechanism adjusts the nip pressure of the nip portion.

The pressure adjustment mechanism includes an arm member, a compression spring, a lever, a roller, an eccentric cam, and a driving gear train. The arm member supports the pressure member at one end side such that the pressure member freely rotates. The compression spring presses the other end side of the arm member to press the pressure member to the fixing member. The lever is provided at the other end side of the arm member in parallel to the arm member and is pressed at the spring pressure of the compression spring together with the arm member. The roller is supported to the lever so as to freely rotate. The eccentric cam is provided at the other side of the lever so as to be rotatable in parallel to the lever, and abuts the roller. The driving gear train transmits driving force to the eccentric cam to rotate the eccentric cam.

The eccentric cam has a maximum radius part and a minimum radius part. The minimum radius part is provided at a position separated from the maximum radius part and is configured with a bottom surface of a concave portion. When the roller faces the concave portion, the pressure member is brought into press contact with the fixing member at the spring pressure of the compression spring via the lever and the arm member. When the roller faces the maximum radius part, the pressure member moves in a direction separating from the fixing member via the lever and the arm member against the spring pressure of the compression spring.

An image forming apparatus according to another aspect of the present disclosure includes the fixing device.

DETAILED DESCRIPTION

Hereinafter, an embodiment of the present disclosure will be described in detail on the basis of the drawings. It is noted that the technology of the present disclosure is not limited to the following embodiment.

Figure 1:
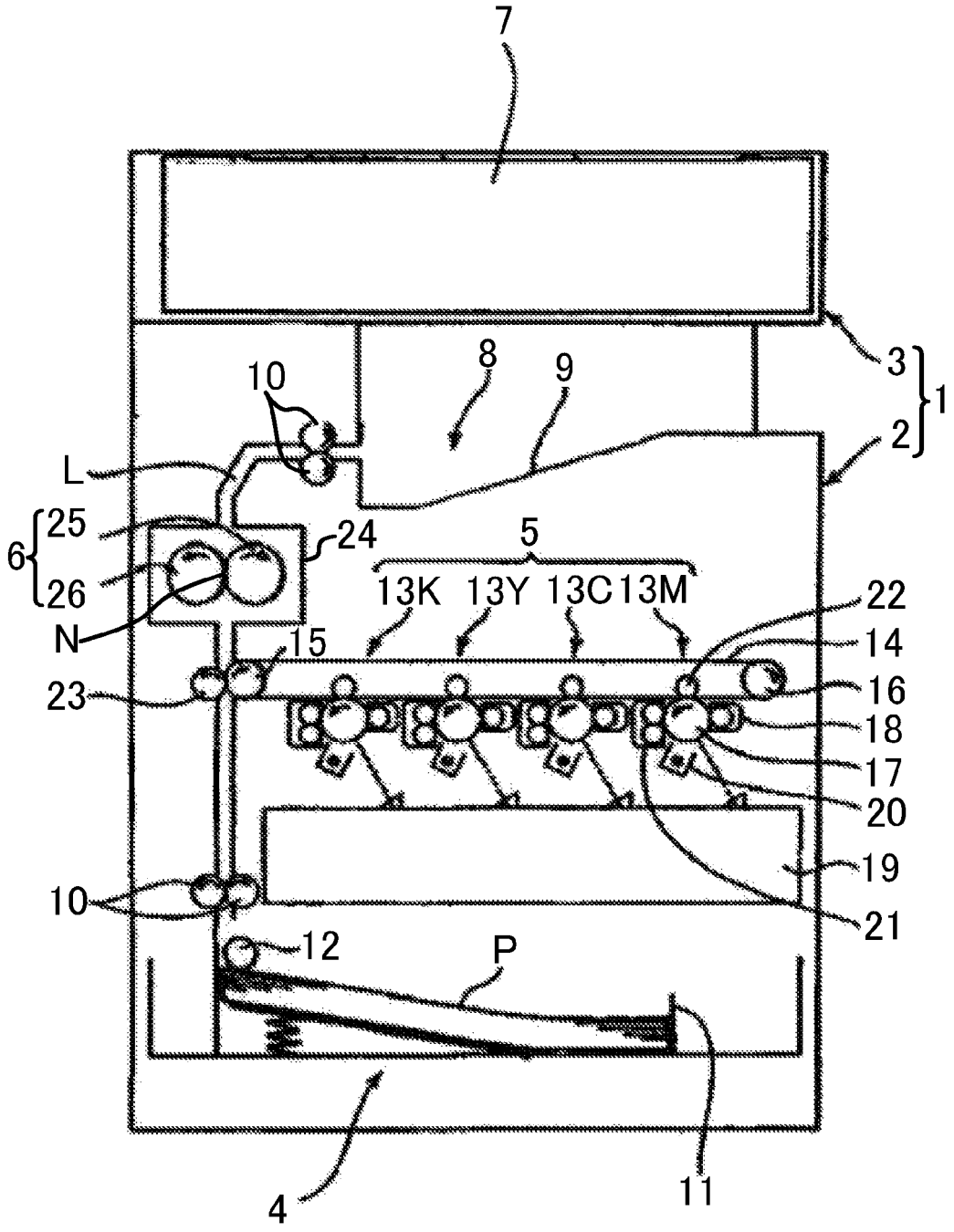
FIG. 1 is a schematic diagram an internal structure of an image forming apparatus.

FIG. 1 illustrates an image forming apparatus 1 and the image forming apparatus 1 is an in-body paper discharge type tandem color copy machine in the present example. The image forming apparatus 1 includes a lower side apparatus body 2 and an upper side apparatus body 3.

In the lower side apparatus body 2, a paper feeding unit 4, an image forming unit 5, a fixing device 6 and the like are accommodated, and in the upper side apparatus body 3, an image reading unit 7 is accommodated. Between the lower side apparatus body 2 and the upper side apparatus body 3, a paper discharge space 8 is formed, and in the paper discharge space 8, a paper discharge tray 9 is provided.

On a paper conveyance path L from the paper feeding unit to the paper discharge space 8, a plurality of conveying rollers 10 are arranged to convey a paper P while interposing the paper P therebetween.

The paper feeding unit 4 has a paper feeding cassette 11 for accommodating the paper P, and a pick-up roller 12 for taking out the paper P in the paper feeding cassette 11 and sending the taken-out paper P to the paper conveyance path L. The paper P sent by the paper feeding cassette 11 is supplied to the image forming unit 5 by the conveying rollers 10.

The image forming unit 5 includes four image forming units 13M, 13C, 13Y, and 13K arranged for a magenta, a cyan, a yellow, and a black sequentially from the right side of FIG. 1, and above these image forming units 13M, 13C, 13Y, and 13K, an endless intermediate transfer belt 14 is arranged to be stretched to a driving roller 15 and a tension roller 16.

Each of the image forming units 13M, 13C, 13Y, and 13K includes a photosensitive drum 17 serving as an image carrying member, and around the photosensitive drum 17, a developing device 18, an exposure device 19, a charging device 20, and a cleaning device 21 are arranged.

The charging device 20 uniformly charges the peripheral surface of the photosensitive drum 17. The exposure device 19 is provided with a laser light source, a polygon mirror and the like (not illustrated), and laser light emitted from the laser light source is irradiated to the peripheral surface of the photosensitive drum 17 via the polygon mirror. By the irradiated laser light, an electrostatic latent image corresponding to predetermined image data (for example, document image data read by the image reading unit 7) is formed on the peripheral surface of the photosensitive drum 17. The developing device 18 supplies toner to the electrostatic latent image on the peripheral surface of the photosensitive drum 17, thereby developing the electrostatic latent image into a toner image.

The photosensitive drum 17 makes contact with the intermediate transfer belt 14 from below and is brought into press contact with the intermediate transfer belt 14 at a primary transfer roller 22, thereby forming a primary transfer part. In this primary transfer part, the toner image of each photosensitive drum 17 is sequentially transferred to the intermediate transfer belt 14 at a predetermined timing together with the rotation of the intermediate transfer belt 14. In this way, on the surface of the intermediate transfer belt 14, a toner image, onto which toner images of four colors of a magenta, a cyan, a yellow, and a black have been superposed, is formed on the surface of the intermediate transfer belt 14.

The cleaning device 21 cleans toner attached to and remaining on the peripheral surface of the photosensitive drum 17 after the transfer. In addition, although not illustrated in the drawing, on the peripheral surface of the photosensitive drum 17, a charge eliminating device is arranged to eliminate remaining charge on the peripheral surface of the photosensitive drum 17. In this way, the image forming unit 5 is configured.

Below the fixing device 6 of the paper conveyance path L, a secondary transfer roller 23, to which a bias potential has been applied, is arranged to face the driving roller 15, wherein the secondary transfer roller 23 is brought into press contact with the intermediate transfer belt 14 while interposing the intermediate transfer belt 14 between the driving roller 15 and the secondary transfer roller 23, thereby forming a secondary transfer part. In this secondary transfer part, the toner image on the surface of the intermediate transfer belt 14 is transferred to the paper P and the paper P after the transfer is supplied to the fixing device 6. After the transfer, a belt cleaning device (not illustrated) cleans toner remaining on the intermediate transfer belt 14.

Figure 2:
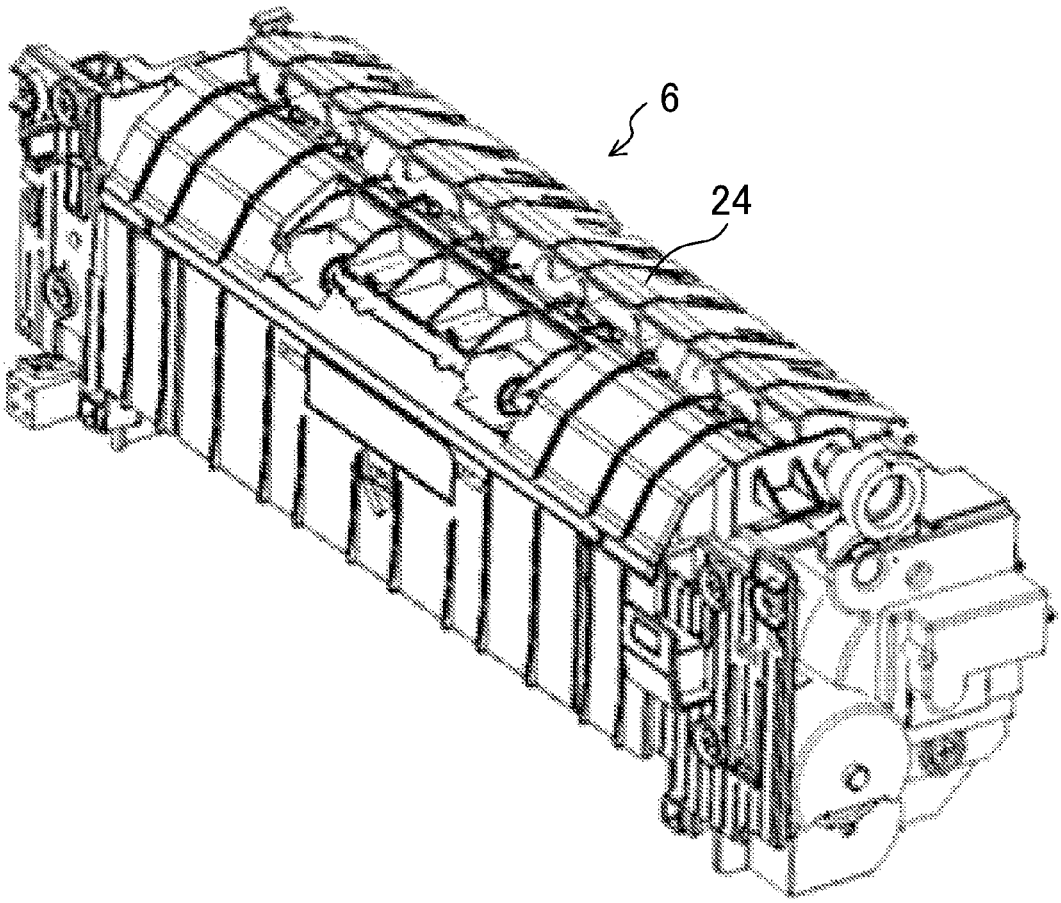
FIG. 2 is a perspective view illustrating an external appearance of a fixing device.
Figure 3:
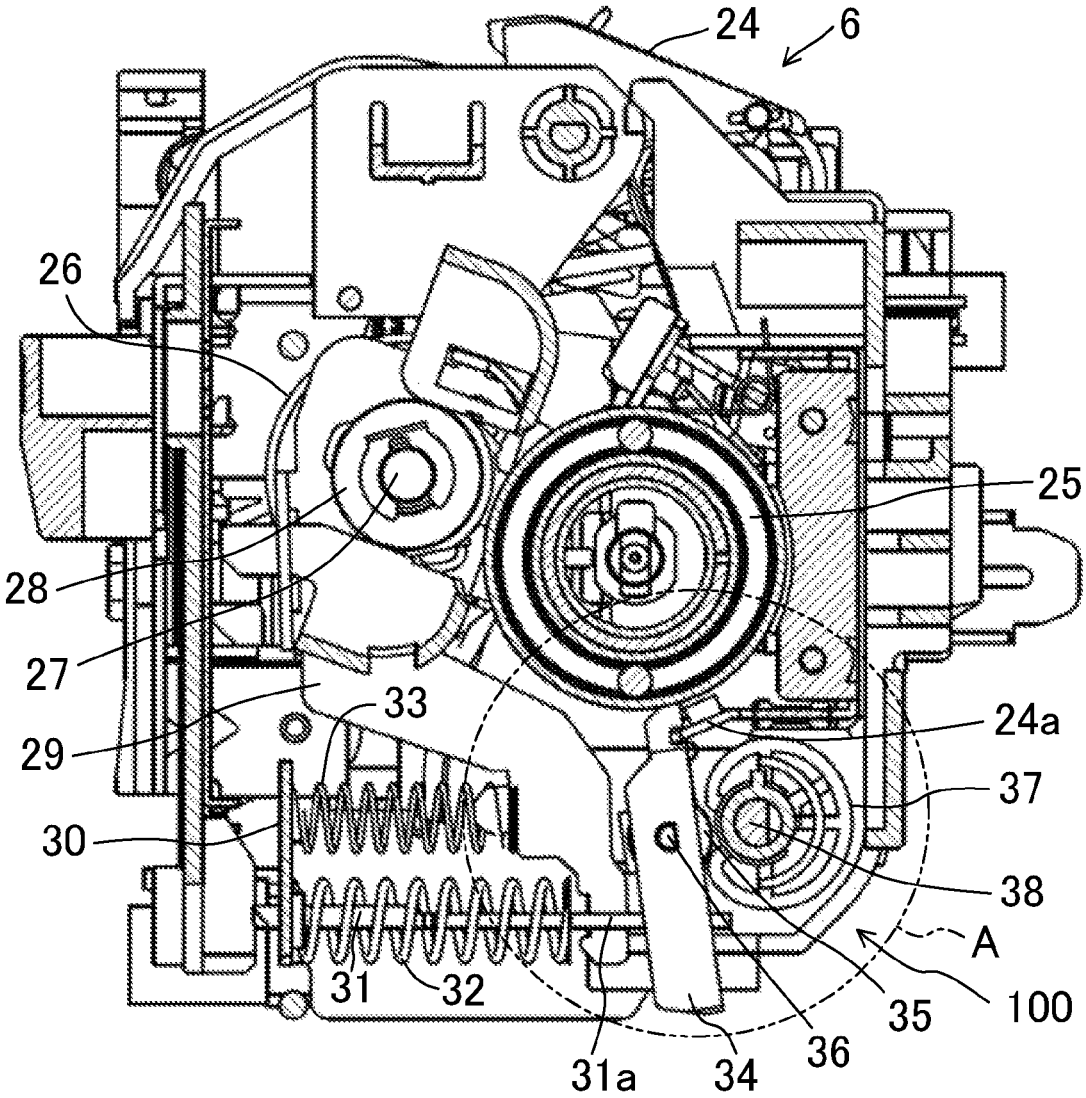
FIG. 3 is a sectional view illustrating an internal structure of a fixing device.

The fixing device 6 includes a fixing roller (a fixing member) 25 and a pressure roller (a pressure member) 26 accommodated in a fixing housing 24 (see FIG. 2 and FIG. 3). The fixing roller 25 has a halogen heater serving as a heat source therein. The fixing roller 25 is heated by the halogen heater. The pressure roller 26 is brought into press contact with the fixing roller 25, so that a nip portion N (see FIG. 1) is formed therebetween. The paper P, which has been supplied to the fixing device 6 from the image forming unit 5 and has carried an unfixed toner image, is interposed in the nip portion N between the fixing roller 25 and the pressure roller 26, and is heated and pressed. In this way, the unfixed toner image on the paper P is molten and is fixed to the paper P.

The paper P with the fixed toner image by the fixing device 6 is sent to a downstream side of the paper conveyance path L by the fixing roller 25 and the pressure roller 26, and is discharged to the paper discharge tray 9 of the paper discharge space 8 by the conveying rollers 10.

As illustrated in FIG. 3, a spindle 27 protrudes at both ends of the pressure roller 26 and is supported to a bearing 28. The bearing 28 is fixed to an upper end side of an arm member 29 vertically extending. The upper end of the arm member 29 is supported to the fixing housing 24 at a rotating shaft (not illustrated). The arm member 29 supports the pressure roller 26 at an upper end side such that the pressure roller 26 freely rotates. Furthermore, the arm member 29 is configured to rotate up and down by employing the aforementioned rotating shaft as a fulcrum.

Figure 7:
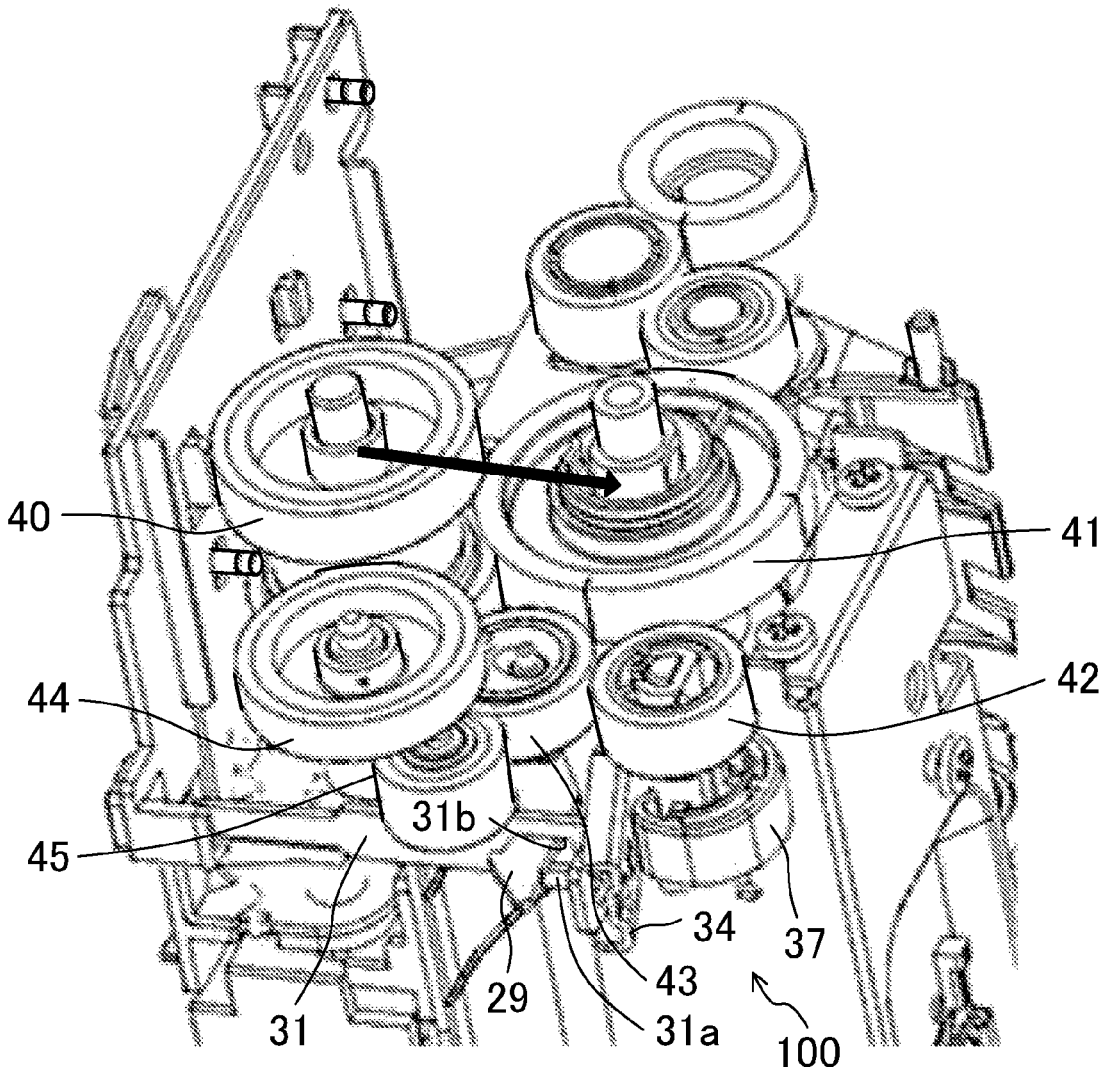
FIG. 7 is an explanation diagram of power transmission at the time of rotation of a fixing roller.

At a lower end of the fixing housing 24, a fixed plate 30 is mounted, and one end (the left end of FIG. 3) of an expandable plate-shaped bar 31 horizontally extending is fixed to the fixed plate 30. At the other end (the right end of FIG. 3) side of the bar 31, a width wide part 31*a* (see FIG. 7 to FIG. 9) wide in a transverse direction (a direction of the front and rear sides of a paper) is formed, and at the width wide part 31*a*, an insertion hole 31*b* (see FIG. 7 to FIG. 9) is formed. In the insertion hole 31*b*, a front end of the arm member 29 is inserted with a margin in a longitudinal direction of the bar 31. The width of the other end (the right end of FIG. 3) of the bar 31 is narrowed. The other end of the bar 31 is supported to a lever 34 (which will be described later) by passing through a lower end side of the lever 34.

The bar 31 is wound by a lower compression spring 32. The lower compression spring 32 is compressively interposed between the fixed plate 30 and an end edge 31*c* of the width wide part 31*a* and extends the bar 31 at spring pressure. Furthermore, the lower compression spring 32 presses a lower end side of the arm member 29 by the bar 31, thereby rotating the arm member 29 counterclockwise by employing the rotating shaft as a fulcrum in FIG. 3. Accordingly, the lower compression spring 32 presses the pressure roller 26 to the fixing roller 25.

In the vicinity of an upper portion of the lower compression spring 32, an upper compression spring 33 is provided in parallel to the lower compression spring 32. one end (the left end of FIG. 3) of the upper compression spring 33 is fixed to the fixed plate 30. The other end (the right end of FIG. 3) of the upper compression spring 33 is fixed to the arm member 29. The upper compression spring 33 presses the arm member 29 counterclockwise in FIG. 3 at weak spring pressure corresponding to about 1/10 of the spring pressure of the lower compression spring 32 when the lower compression spring 32 has been almost fully extended.

Figure 4:
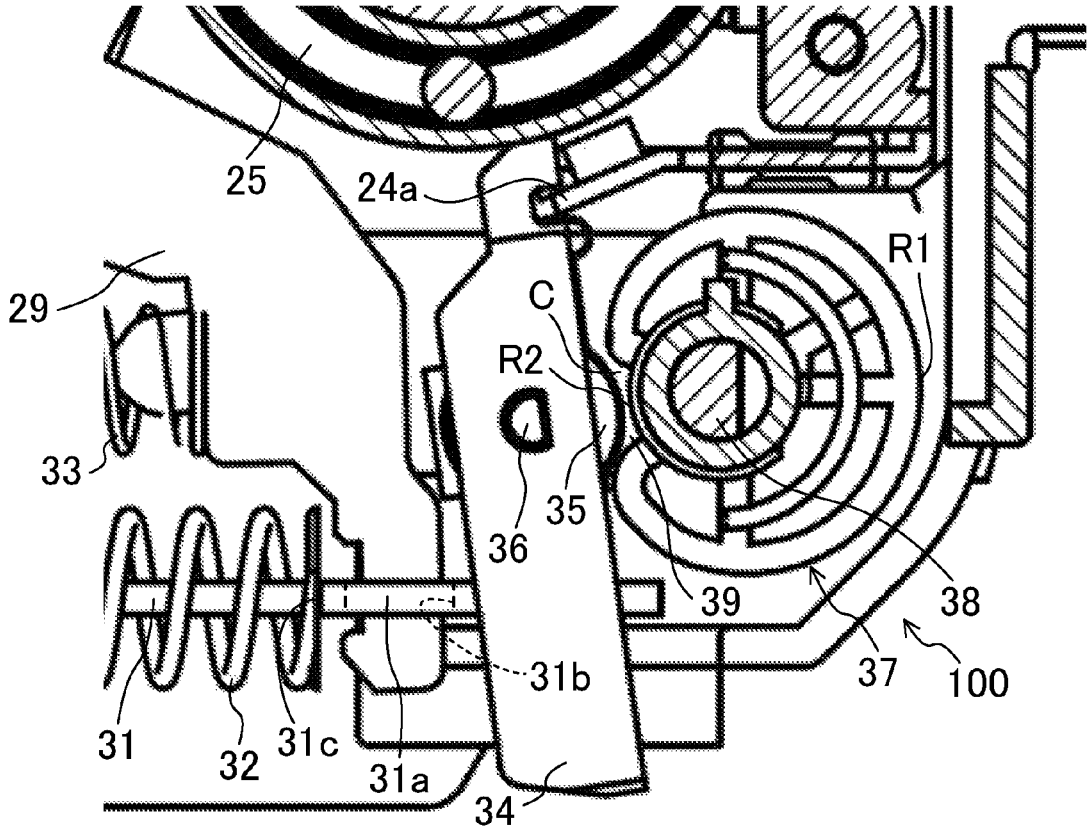
FIG. 4 is an enlarged view of a part A of FIG. 3.

At the lower end side of the arm member 29 and an opposite side of the lower compression spring 32 and the upper compression spring 33, the lever 34 extending up and down is provided in parallel to the arm member 29 as enlarged in FIG. 4. An upper end of the lever 34 is supported to a fixed side 24*a* of the fixing housing 24. Furthermore, the lever 34 is configured to be pressed at the spring pressure of the lower compression spring 32 together with the arm member 29 and to rotate up and down. Furthermore, a roller 35 is supported to the lever 34 so as to freely rotate at a shaft 36.

At a lateral side of the lever 34, which is opposite to the arm member 29 side, an eccentric cam 37 abutting the roller 35 is provided. The eccentric cam 37 is supported by a cam shaft 38 so as to be rotatable. As enlarged in FIG. 5, the eccentric cam 37 has a maximum radius part R1 remote from the cam shaft 38 and a minimum radius part R2 near the cam shaft 38 provided at a position separated from the maximum radius part R1 by 180°. The maximum radius part R1 is formed such that its central angle θ has a range of about 60° in order to prevent the roller 35 from being deviated from the maximum radius part R1 even though there is displacement in the position of the roller 35.

The minimum radius part R2 of the eccentric cam 37 is configured with a bottom surface of a concave portion 39. The minimum radius part R2 is configured such that a part of the roller 35 is fitted into the concave portion 39 when the roller 35 faces the minimum radius part R2. In this way, when the eccentric cam 37 is switched from the maximum radius part R1 to the minimum radius part R2, the spring pressure of the lower compression spring 32 is released, so that the roller 35 is vigorously fitted into the concave portion 39. Simultaneously, the roller 35 is flown out from the concave portion 39 by repulsive force of the lower compression spring 32. However, the flowing-out of the roller 35 is restrained at a side wall of the concave portion 39. Consequently, the roller 35 stably stops in the minimum radius part R2 without excessively going beyond the minimum radius part R2, so that the eccentric cam 37 is prevented from rotating more than necessary. Consequently, the eccentric cam 37 is not rotated beyond a rotation angle formed by a motor to be described later, and stops at a prescribed stop position. Thus, it is possible to achieve the stabilization of nip pressure and to improve the fixing performance of the fixing device 6.

Figure 5:
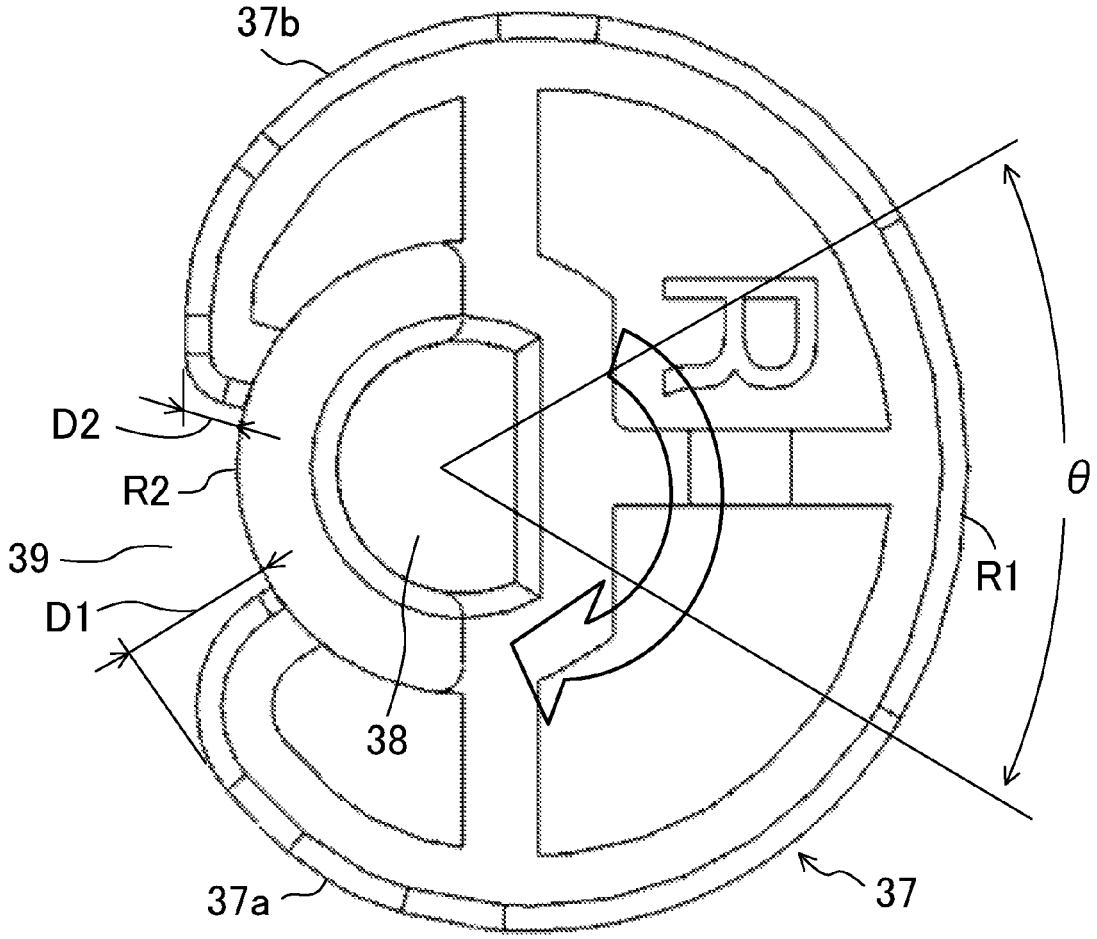
FIG. 5 is an enlarged view of an eccentric cam.
Figure 6:
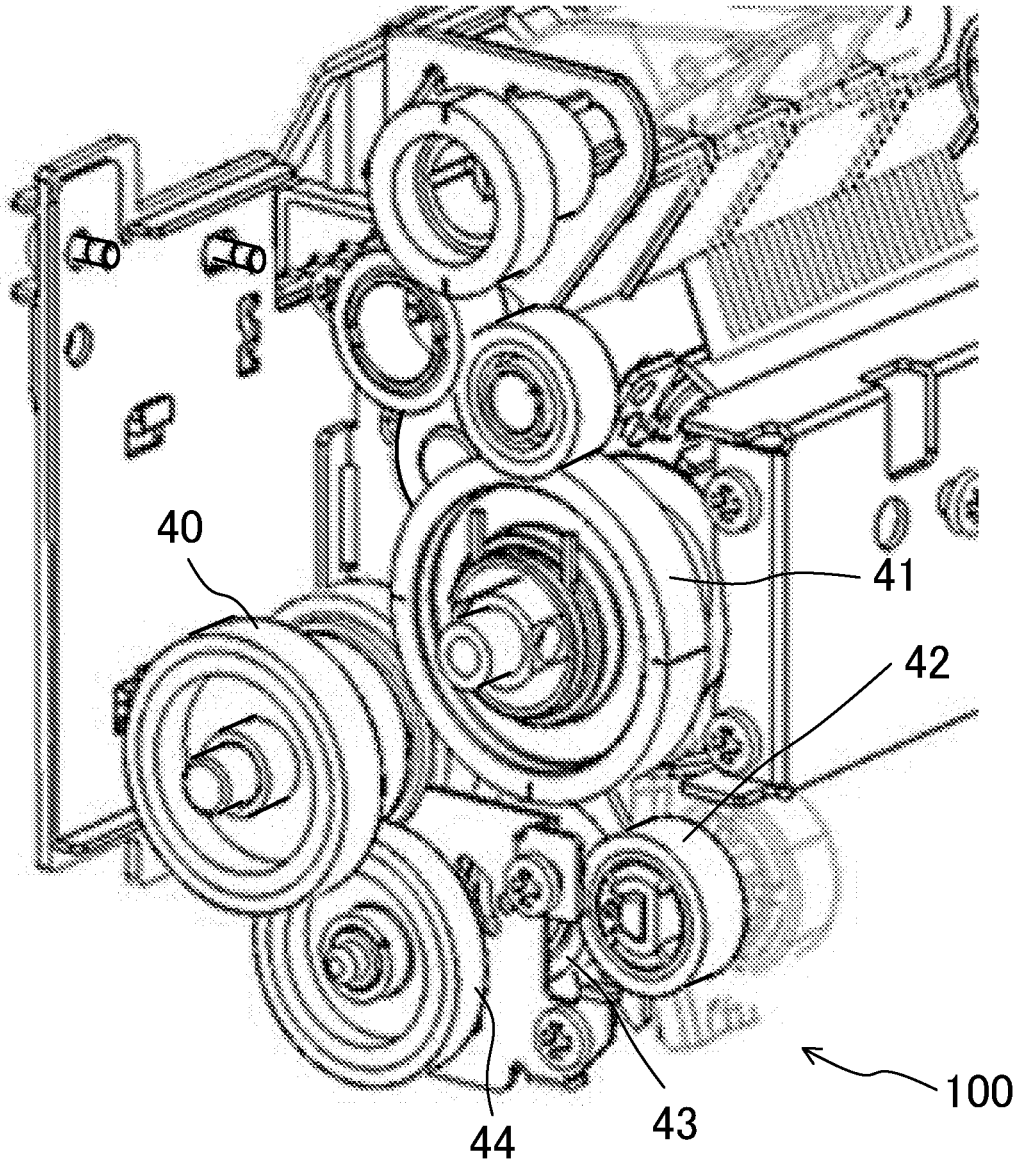
FIG. 6 is a perspective view illustrating a driving configuration of a fixing device.

In FIG. 5, in the eccentric cam 37, an upward inclined surface 37*a* is formed at a lower side (an upstream side in a rotation direction) by the concave portion 39 and a downward inclined surface 37*b* is formed at an upper side (a downstream side in the rotation direction) by the concave portion 39. Since a depth D1 of the upward inclined surface 37*a* in the concave portion 39 is larger than a depth D2 of the downward inclined surface 37*b* in the concave portion 39, the eccentric cam 37 is asymmetrical. In this way, it is possible to allow the roller 35 to smoothly face the concave portion 39 of the eccentric cam 37 having rotated clockwise as indicated by an arrow of FIG. 5, and to prevent overrotation of the eccentric cam 37. Furthermore, the depth D2 of the downward inclined surface 37*b* is smaller than the depth D1 of the upward inclined surface 37*a*, so that the inclination of downward inclined surface 37*b* becomes gentle. In this way, it is possible to minimize force applied to the eccentric cam 37 from the roller 35 when the eccentric cam 37 is switched from the maximum radius part R1 to the minimum radius part R2.

As illustrated in FIG. 3 and FIG. 4, when the roller 35 faces the concave portion 39 (the minimum radius part R2), the bar 31 extends at the spring pressure of the lower compression spring 32 and the lever 34 rotates counterclockwise in FIG. 3. Accordingly, the arm member 29 rotates counterclockwise by employing the rotating shaft as a fulcrum in FIG. 3. Therefore, the pressure roller 26 is brought into press contact with the fixing roller 25 via the lever 34 and the arm member 29, so that predetermined nip pressure is generated at the nip portion N. In the state in which the roller 35 faces the minimum radius part R2, a gap C is formed between the roller 35 and the bottom surface (the minimum radius part R2) of the concave portion 39 (see FIG. 4). In this way, it is possible to apply the spring pressure of the lower compression spring 32 to the pressure roller 26 without loss.

On the other hand, when the roller 35 faces the maximum radius part R1 positioned at an opposite side of the minimum radius part R2 by 180°, the lever 34 is pressed to the maximum radius part R1 to rotate clockwise, thereby shrinking the bar 31 against the spring pressure of the lower compression spring 32. Accordingly, the arm member 29 rotates clockwise by employing the rotating shaft as a fulcrum in FIG. 3, so that the pressure roller 26 moves in a direction separating from the fixing roller 25 via the lever 34 and the arm member 29 and the nip pressure of the nip portion N is reduced or released.

Such adjustment of the nip pressure is performed by a nip pressure adjustment mechanism 100 including the above-described arm member 29, bar 31, lower compression spring 32, upper compression spring 33, lever 34, roller 35, eccentric cam 37 and the like.

The nip pressure adjustment mechanism 100 also includes a driving gear train (see FIG. 6 to FIG. 9) that transmits driving force to the eccentric cam 37 to rotate the eccentric cam 37. That is, the nip pressure adjustment mechanism 100 includes a driving input gear 40 connected to a motor (a stepping motor, not illustrated), a fixing roller gear 41 mounted so as to rotate together with the fixing roller 25, a cam driving gear 42 mounted so as to rotate together with the eccentric cam 37, a planet gear 43 moving according to a rotation operation of the driving input gear 40, and intermediate gears 44 and 45 arranged between the driving input gear 40 and the planet gear 43. The driving input gear 40 has a one-way clutch (not illustrated) therein. The cam shaft 38 is mounted with an actuator (not illustrated), wherein the actuator is detected by a PI (Photo Interrupter sensor) (not illustrated), so that the orientation of the eccentric cam 37 is reverse-controlled by 180°.

At the time of normal rotation of the fixing roller 25, counterclockwise rotation driving force is inputted to the driving input gear 40 from the motor and the planet gear 43 is separated from the cam driving gear 42, resulting in a release of engagement with the cam driving gear 42. Furthermore, the one-way clutch embedded in the driving input gear 40 is rotated in an engagement direction and the rotation driving force of the driving input gear 40 is transmitted to the fixing roller gear 41 as indicated by an arrow of FIG. 7. In this step, the eccentric cam 37 allows the minimum radius part R2 to face the roller 35, so that a part of the roller 35 is fitted into the concave portion 39 as illustrated in FIG. 3 and FIG. 4. Furthermore, the arm member 29 and the lever 34 rotate counterclockwise by the spring pressure of the lower compression spring 32 to press the pressure roller 26 to the fixing roller 25, thereby generating predetermined nip pressure at the nip portion N.

Figure 8:
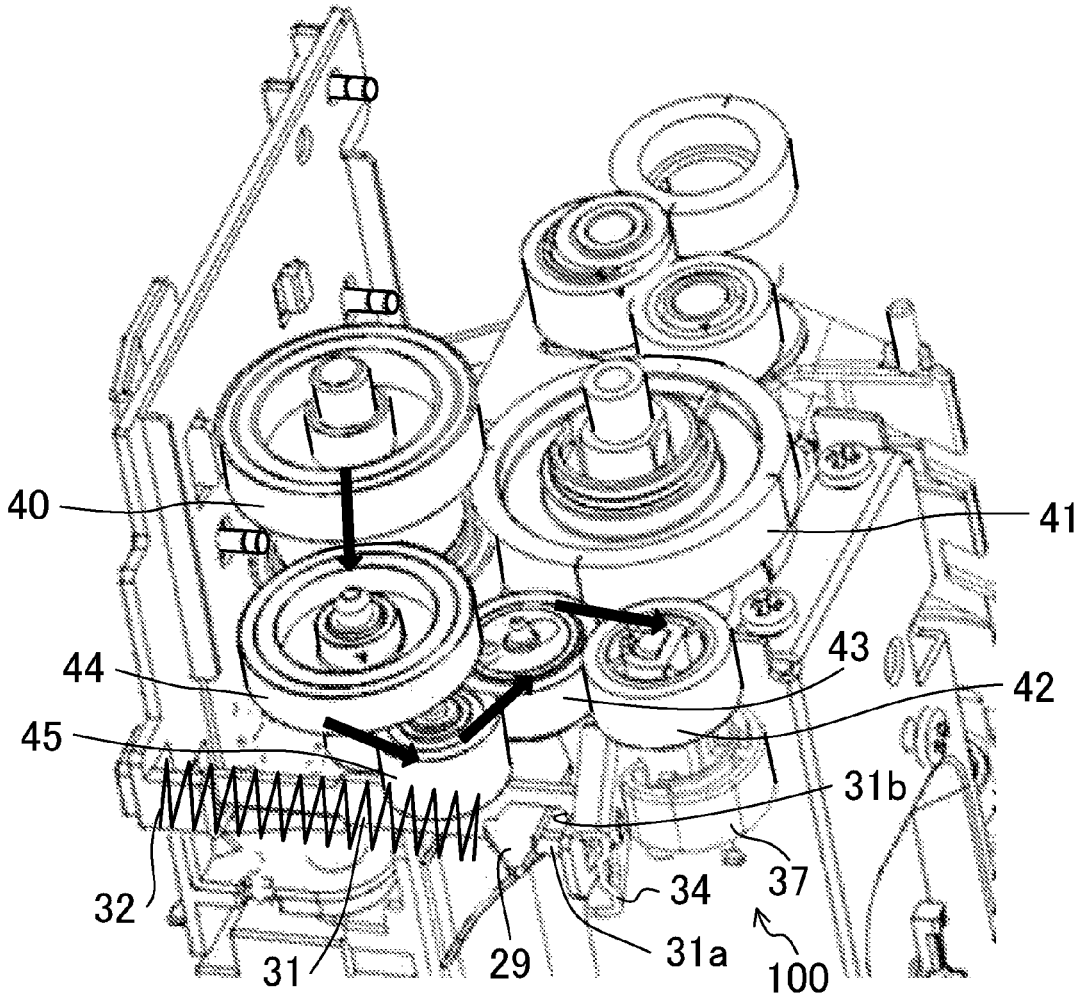
FIG. 8 is an explanation diagram of power transmission in a state of preparing a situation to reduce or release nip pressure from the state of FIG. 7.
Figure 9:
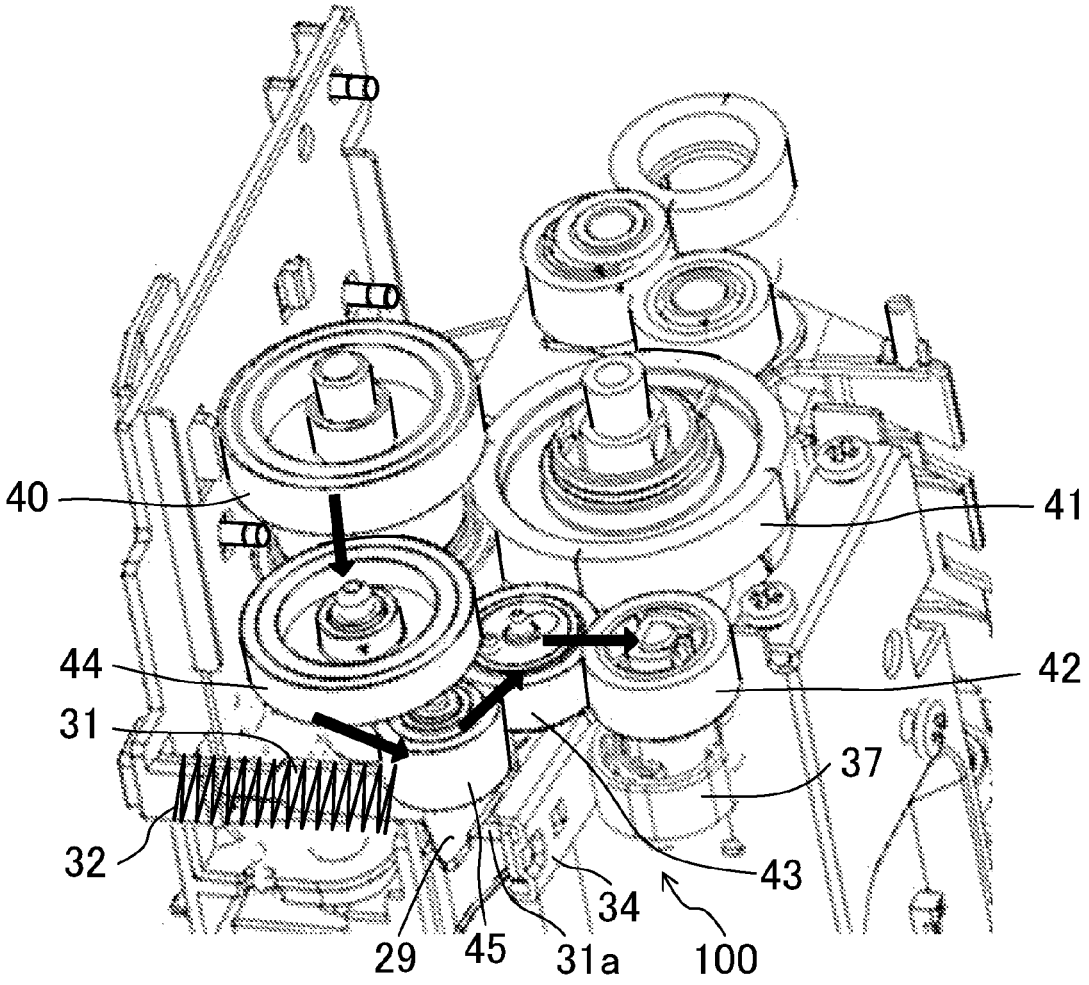
FIG. 9 is an explanation diagram of a state in which nip pressure has been reduced or released from the state of FIG. 8.

On the other hand, when the nip pressure of the nip portion N is adjusted in order to prevent wrinkles at the time of paper passing of an envelope and the like or to prevent C set phenomenon of the fixing roller 25, clockwise rotation driving force is inputted to the driving input gear 40 from the motor and the planet gear 43 approaches the cam driving gear 42 to engage with the cam driving gear 42. Furthermore, the one-way clutch embedded in the driving input gear 40 is rotated in a sliding direction and the rotation driving force of the driving input gear 40 is transmitted to only the cam driving gear 42 from the intermediate gears 44 and 45 via the planet gear 43 as indicated by an arrow of FIG. 8 and FIG. 9. By the rotation of the cam driving gear 42, the eccentric cam 37 rotates 180° and the roller 35 is escaped from the concave portion 39, so that the maximum radius part R1 of the eccentric cam 37 faces the roller 35. In this way, the arm member 29 and the lever 34 rotate clockwise while shrinking the lower compression spring 32 and move the pressure roller in a direction separating from the fixing roller 25 as illustrated in FIG. 8 and FIG. 9, so that the nip pressure of the nip portion N is reduced or released.

From this state, when the eccentric cam 37 is switched to the minimum radius part R2 from the maximum radius part R1, since the roller 35 faces the concave portion 39, unnecessary rotation of the eccentric cam 37 is restrained as described above. In this way, it is possible to stop the eccentric cam 37 at a prescribed stop position by the roller 35, so that it is possible to obtain the image forming apparatus 1 including a fixing device having a stable fixing function.

In addition, in the aforementioned embodiment, as the fixing device 6, a roller fixing scheme has been exemplified; however, the technology of the present disclosure is not limited thereto and it goes without saying that it can be applied to a belt fixing scheme.

Furthermore, in the aforementioned embodiment, the case in which the image forming apparatus 1 is a color copy machine has been described; however, the technology of the present disclosure is not limited thereto and can be applied to various image forming apparatuses such as a color printer, a monochrome copy machine, a monochrome printer, a digital multifunctional peripheral, a facsimile and the like.

As described above, the technology of the present disclosure is useful for a fixing device having a nip pressure adjustment mechanism for adjusting the nip pressure of a nip portion formed by press-contact between a fixing member such as a fixing roller and a fixing belt and a pressure member such as a pressure roller, and an image forming apparatus including the same.

What is claimed is:

1. A fixing device comprising:

a fixing member;

a pressure member which is brought into press contact with the fixing member and forms a nip portion at which the pressure member interposes a paper carrying an unfixed toner image between the fixing member and the pressure member, melts the unfixed toner image, and fixes the molten toner image to the paper; and a nip pressure adjustment mechanism that adjusts nip pressure of the nip portion, wherein the nip pressure adjustment mechanism comprises:

an arm member that supports the pressure member at one end side such that the pressure member freely rotates;

a compression spring that presses the other end side of the arm member to press the pressure member to the fixing member;

a lever provided at the other end side of the arm member in parallel to the arm member and pressed at spring pressure of the compression spring together with the arm member;

a roller supported to the lever so as to freely rotate;

an eccentric cam provided at the lateral side of the lever so as to be rotatable in parallel to the lever, and abutting the roller; and a driving gear train that transmits driving force to the eccentric cam to rotate the eccentric cam, wherein the eccentric cam has a maximum radius part and a minimum radius part provided at a position separated from the maximum radius part and configured with a bottom surface of a concave portion, and when the roller faces the concave portion, the pressure member is brought into press contact with the fixing member at the spring pressure of the compression spring via the lever and the arm member, and when the roller faces the maximum radius part, the pressure member moves in a direction separating from the fixing member via the lever and the arm member against the spring pressure of the compression spring.

2. The fixing device of claim 1, wherein, in the concave portion, a depth of an upstream side in a rotation direction is larger than a depth of a downstream side in the rotation direction.

3. The fixing device of claim 1, wherein, in a state in which the roller faces the minimum radius part, a gap is formed between the roller and the concave portion.

4. An image forming apparatus including the fixing device of claim 1.

* * * * *